US006475010B1

(12) United States Patent
Yu

(10) Patent No.: US 6,475,010 B1
(45) Date of Patent: Nov. 5, 2002

(54) ELECTRICAL CONNECTOR ASSEMBLY

(75) Inventor: Hung-Chi Yu, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/035,550

(22) Filed: Dec. 27, 2001

(51) Int. Cl.[7] ..... H01R 13/28
(52) U.S. Cl. ..... 439/289; 439/293; 439/357
(58) Field of Search ..... 439/289–293, 439/74, 660, 357, 862

(56) References Cited

U.S. PATENT DOCUMENTS 5,234,353 A * 8/1993 Scholz et al. ..... 439/289
5,429,525 A * 7/1995 McCoy ..... 439/357
5,730,613 A * 3/1998 Yamada ..... 439/293
5,895,284 A * 4/1999 Kocher et al. ..... 439/357

* cited by examiner

*Primary Examiner*—Hien Vu
(74) *Attorney, Agent, or Firm*—Wei Te Chung

(57) ABSTRACT

An electrical connector assembly (1) used for a notebook computer comprises a receptacle connector (10) mounted on a mother board and a plug connector (20) mounted on a LED panel which is rotatably fitted into the notebook computer. The receptacle connector includes a first insulative housing (12) defining at least two first holes (152) and two rows of first terminals (22) retained in the first housing. The plug connector is rotatable with the rotation of the LED panel to mate with the receptacle connector and includes a second insulative housing (22) and two rows of second terminals (24) retained in the second housing for mating with corresponding first terminals. The second housing forms at least two second embossments (238) for latching into the at least two first holes of the receptacle connector, thereby securely retaining the receptacle and plug connectors together.

4 Claims, 3 Drawing Sheets

ELECTRICAL CONNECTOR ASSEMBLY

BACKGROUND OF THE INVENTION

1. Field of the Invention

The present invention relates to an electrical connector assembly, and particularly to a board to board connector assembly used for a notebook computer.

2. Description of Prior Art

Electrical board to board connectors are well known to the pertinent art and are widely used in personal computers, such as desktop computers, notebook computers and so on. Commonly, board to board connectors are used in pairs and comprise a receptacle connector mounted on a mother board and a plug connector mounted on a daughter board for vertically engaging/disengaging with/from the receptacle connector. Thus, the board to board connectors are commonly structured to fit for such a vertical engagement therebetween. However, sometimes there are some special requirements wanted by certain users, for example, especially in a notebook computer, a LED panel on which a plug connector is mounted is required to rotatably fastened to a mother board on which a receptacle connector is mounted for mating with the plug connector. Accordingly, the plug connector is rotated to mate with the receptacle connector with the rotation of the LED panel. If the receptacle and plug connectors are conventionally structured, the plug connector will not be reliable mated with the receptacle connector due to structure limitation thereof. Thus, it is desirable to provide a receptacle and plug connector assembly having a structure which is fitted for such a non-vertical engagement between the receptacle and plug connectors thereof.

BRIEF SUMMARY OF THE INVENTION

A main object of the present invention is to provide an electrical connector assembly having a receptacle connector and a plug connector rotatably and reliably mated with the receptacle connector.

An electrical connector assembly in accordance with the present invention is adapted for electrically connected between a mother board and a LED panel in a notebook computer. The electrical connector assembly comprises a receptacle connector mounted on a mother board and a plug connector mounted on the LED panel which is rotatably assembled in the notebook computer. The receptacle connector includes a first insulative housing and two rows of first terminals retained in the first insulative housing. The first housing has a first body portion and a first side wall defining at least two first holes and projecting upward from a side edge of the first body portion. The plug connector is rotatable with the rotation of the LED panel to mate with the receptacle connector and includes a second insulative housing and two rows of second terminals being retained in the second insulative housing for mating with corresponding first terminals of the receptacle connector. The second housing forms at least two second embossments on a lateral side thereof for latching into the at least two first holes of the receptacle connector, thereby securely retaining the receptacle and plug connectors together.

Other objects, advantages and novel features of the invention will become more apparent from the following detailed description of the present embodiment when taken in conjunction with the accompanying drawings.

DETAILED DESCRIPTION OF THE INVENTION

Figure 1:
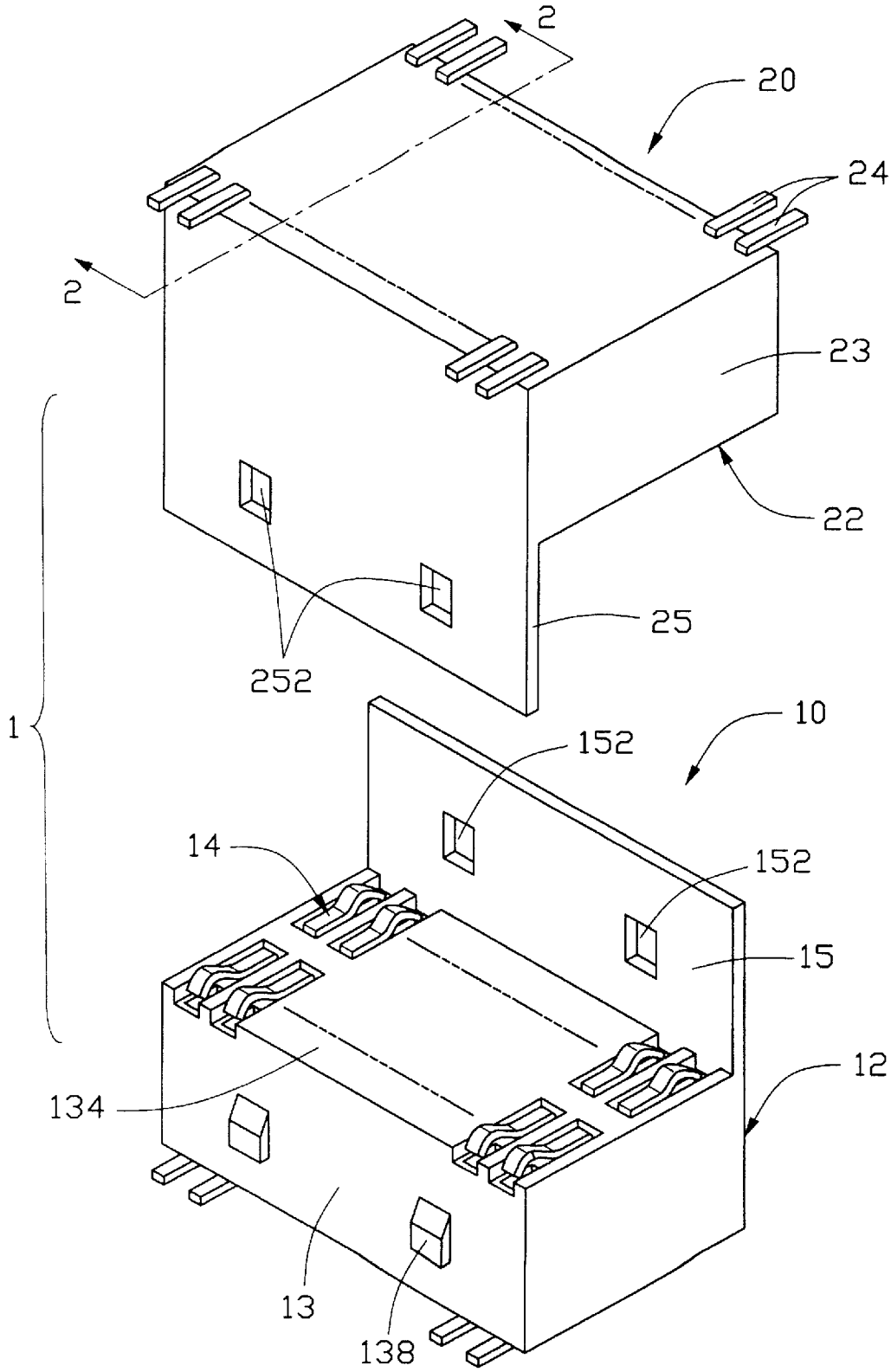
FIG. 1 is an exploded perspective view of an electrical connector assembly in accordance with the present invention.

The preferred embodiment of the present invention is detailed described below to the drawing figures.

Figure 2:
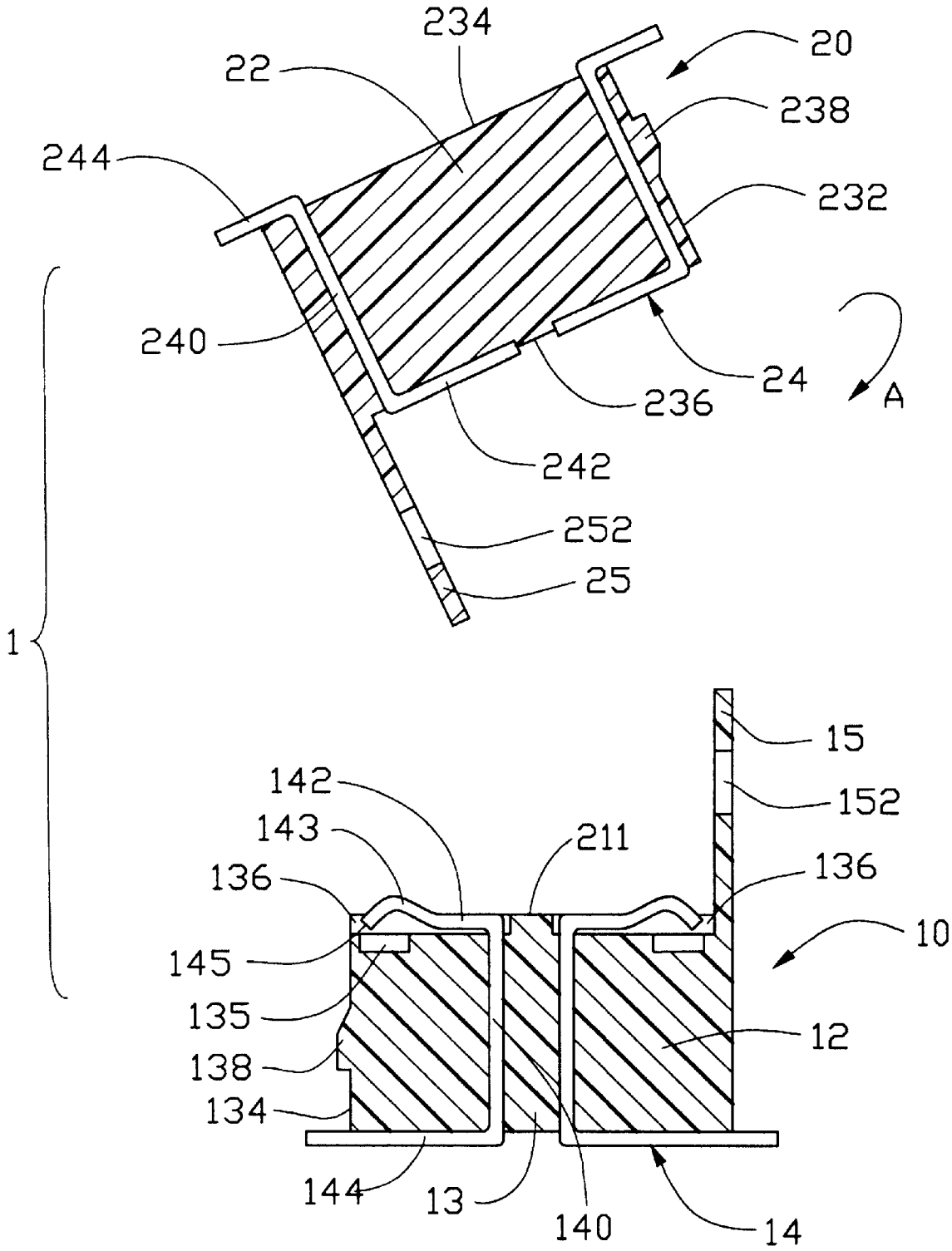
FIG. 2 is a cross-sectional view of FIG. 1.

Referring to FIGS. 1 and 2, a board to board connector assembly 1 in accordance with the present invention is used for a notebook computer and comprises a receptacle connector 10 to be mounted on an underlying mother board (not shown), and a plug connector 20 to be mounted on a LED panel (not shown) for rotatably engaging with the receptacle connector 10.

The receptacle connector 10 includes a first insulative housing 12 and two rows of the first terminals 14 retained in the first housing 12 by way of insert molding. The first housing 12 has a first elongate body portion 13 and a first side wall 15 vertically projecting from a side edge of the first body portion 13. The first body portion 13 defines two rows of the first passageways 136 laterally extending in a top faces 134. In addition, a recess 135 is defined below and communicated with each first passageway 136. In the preferred embodiment of the present invention, the first body portion 13 further forms a pair of embossments 138 on a lateral side thereof opposite to the first side wall 15, and the number of embossments 138 may be more if desired. Additionally, the first side wall 15 defines a pair of through holes 152 therein. The two rows of the first terminals 14 are insert molded in the first insulative housing 12 and have symmetric structures with respect to a central axis (not shown) of the first body portion 13. Each first terminal 14 has a retaining portion 140 molded in the first body portion 13, a mating portion 142 and a soldering portion 144 extending from opposite ends of the retaining portion 140, respectively. The mating portion 142 extends into a corresponding passageway 136, and forms an arc-shaped contact portion 143 and a tip end 145 extending downward from the contact portion 143. The tip end 145 is distancedly aligned with an associated recess 135 below the corresponding passageway 136, and is received in the associated recess 135 when the receptacle and plug connectors 10, 20 are fully mated with each other, The soldering portion 144 is horizontally soldered to a corresponding footprint (not shown) formed on the mother board by surface mount technology (STA).

The plug connector 20 is vertically mounted on the LED panel which is obliquely located above the mother board to be rotatably assembled with the mother board. Thus, the plug connector 20 is rotated to mate with the receptacle connector 10 with the rotation of the LED panel. The plug connector 20 has a similar structure with the receptacle connector 10 and includes a second insulative housing 22 and two rows of second terminals 24 retained in the second housing 22 by insert molding. The second housing 22 has an elongate second body portion 23 and a second side wall 25 depending downward from a side edge of the second body portion 23. Additionally, the second body portion 23 forms a pair of projections 238 (only one shown) on the other side thereof opposite to the second side wall 25 for latching into corresponding through holes 152 of the first side wall 15 of the receptacle connector 10. The second side wall 25 defines a pair of through windows 252 for receiving corresponding embossments 138 of the receptacle connector 10. The two rows of second terminals 24 have symmetric structures with respect to a central axis of the second body portion 23. Each second terminal 24 has a retaining body 240 retained in the second body portion 23, a mating beam 242 and a soldering tail 244 respectively extending from opposite ends of the retaining body 240 in opposite directions. The mating beam 242 is adapted for mating with a corresponding contact portion 142 of the first terminal 14 of the receptacle connector 10.

Figure 3:
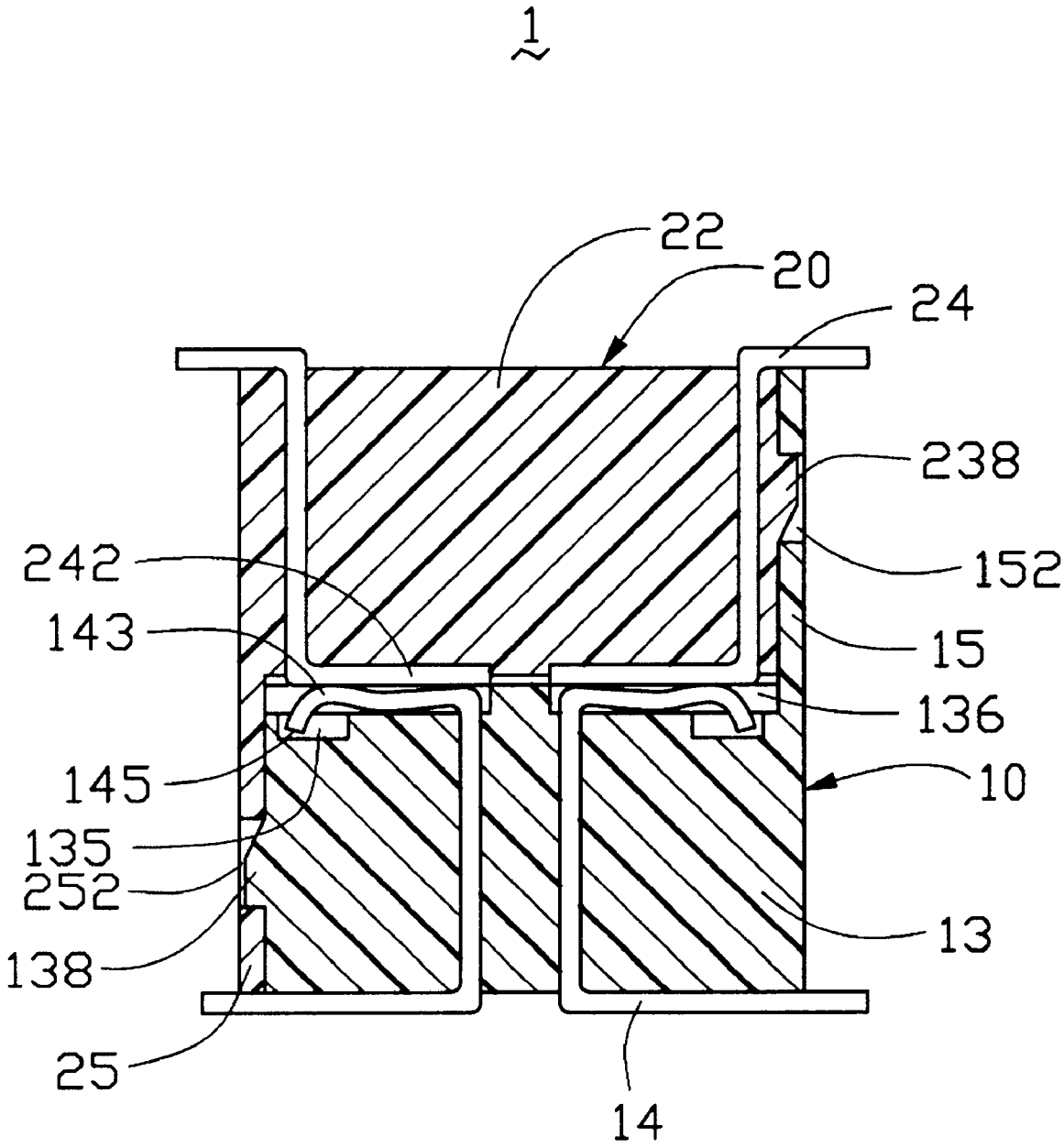
FIG. 3 is an assembled view of FIG. 2.

In assembly or in use, further referring to FIG. 3, the receptacle connector 10 is mounted onto the mother board and the soldering portions 144 of the first terminals 14 thereof are horizontally soldered to corresponding footprints formed on the mother board. The plug connector 20 is vertically fastened onto the LED panel and the soldering tails 244 of the second terminals 24 thereof are soldered to corresponding footprints formed on the LED panel. In this status, the plug connector 20 is inclinedly located above the receptacle connector 10, as shown in FIG. 2. During the LED panel is rotatably assembled with the mother board, the plug connector 10 is downwardly rotated along the clockwise direction, designated as "A", with respect to the receptacle connector 10 until the mating beams 242 of the second terminals 24 thereof are mated with corresponding contact portions 142 of the first terminals 14 of the receptacle connector 10. Meanwhile, the projections 238 and through windows 252 of the plug connector 20 are respectively latched with corresponding embossments 138 and through holes 152 of the receptacle connector 10 for securely retaining the receptacle and plug connectors 10, 20 together. In this way, the receptacle and plug connectors 10, 20 of the present invention are securely and effectively mated with each other without destroying their first and second terminals 14, 24, or breaking off from each other under vibration condition.

It is to be understood, however, that even though numerous characteristics and advantages of the present invention have been set forth in the foregoing description, together with details of the structure and function of the 23, a mating beam 242 and a soldering tail 244 respectively extending from opposite ends of the retaining body 240 in opposite directions. The mating beam 242 is adapted for mating with a corresponding contact portion 142 of the first terminal 14 of the receptacle connector 10.

In assembly or in use, further referring to FIG. 3, the receptacle connector 10 is mounted onto the mother board and the soldering portions 144 of the first terminals 14 thereof are horizontally soldered to corresponding footprints formed on the mother board. The plug connector 20 is vertically fastened onto the LED panel and the soldering tails 244 of the second terminals 24 thereof are soldered to corresponding footprints formed on the LED panel. In this status, the plug connector 20 is inclinedly located above the receptacle connector 10, as shown in FIG. 2. During the LED panel is rotatably assembled with the mother board, the plug connector 10 is downwardly rotated along the clockwise direction, designated as "A", with respect to the receptacle connector 10 until the mating beams 242 of the second terminals 24 thereof are mated with corresponding contact portions 142 of the first terminals 14 of the receptacle connector 10. Meanwhile, the projections 238 and through windows 252 of the plug connector 20 are respectively latched with corresponding embossments 138 and through holes 152 of the receptacle connector 10 for securely retaining the receptacle and plug connectors 10, 20 together. In this way, the receptacle and plug connectors 10, 20 of the present invention are securely and effectively mated with each other without destroying their first and second terminals 14, 24, or breaking off from each other under vibration condition.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly for electrically connecting a daughter board to a mother board, comprising:

a receptacle connector being mounted on a mother board and including a first insulative housing having a first body portion and a first side wall projecting upward from a side edge of the first body portion, the first side wall defining at least two first holes, and two rows of first terminals being retained in the first insulative housing; and a plug connector being mounted on a daughter board and rotatable to mate with the receptacle connector, the plug connector including a second insulative housing forming at least two second embossments on a lateral side thereof for latching into the at least two first holes of the receptacle connector, and two rows of second terminals being retained in the second insulative housing for mating with corresponding first terminals of the receptacle connector; wherein the first body portion of the first insulative housing defines two rows of first passageways in a top face thereof, and a recess below and communicated with each first passageway; wherein each first terminal has a retaining portion retained in the first insulative housing, a mating portion extending from one end of the retaining portion into a corresponding first passageway of the first insulative housing, and a horizontal soldering portion extending from another end of the retaining portion for soldering to the mother board; wherein the mating portion of the first terminal has a tip end for being received into a corresponding recess of the first insulative housing when the receptacle and plug connectors are fully mated with each other; wherein the plug connector is similar to the receptacle connector in structure; wherein the first body portion of the first insulative housing further forms at least two projections on a lateral side thereof opposite to the first side wall.

2. The electrical connector assembly as claimed in claim 1, wherein each second terminal has a retaining body retained in the second insulative housing, a second mating beam extending from one end of the second retaining body for mating with a corresponding mating portion of the first terminal, and a soldering tall extending from another end of the retaining body for soldering to the mother board.

3. The electrical connector assembly as claimed in claim 1, wherein the second insulative housing has a second body portion and a second side wall depending from a side edge thereof and defining at least two through windows for latching with the at least two projections of the first insulative housing.

4. An electrical connector assembly for electrically connecting a daughter board to a mother board, comprising:

a receptacle connector being mounted on a mother board and including a first insulative housing, and two rows of first terminals being retained in the first insulative housing; and a plug connector being mounted on a daughter board and rotatable to mate with the receptacle connector, the plug connector including a second insulative housing defining, and two rows of second terminals being retained in the second insulative housing for mating with corresponding first terminals of the receptacle connector; and latching members respectively formed on the receptacle and plug connectors for retaining the receptacle and plug connectors together; wherein the first insulative housing forms a first body portion and a first side wall projecting upward from a side edge of the first body portion; wherein the latching members formed on the receptacle connector includes at least two through holes defined in the first side wall and at least two projections formed on another lateral side opposite to the first side wall; wherein the second insulative housing forms a second body portion and a second side wall depending downward from a side edge of the second body portion; wherein the latching members formed on the plug connector includes at least two embossments formed at one lateral side of the second body portion opposite to the second side wall and at least two through apertures defined in the second side wall for latching with the at least two through holes and at least two projections of the receptacle connector, respectively.

* * * * *